US005335508A

United States Patent [19]

Tippmann

[11] Patent Number: 5,335,508

[45] Date of Patent: Aug. 9, 1994

[54] REFRIGERATION SYSTEM

[76] Inventor: Edward J. Tippmann, 4538 Doenges Dr., Fort Wayne, Ind. 46815

[21] Appl. No.: 746,886

[22] Filed: Aug. 19, 1991

[51] Int. Cl.[5] ..... F25B 7/00

[52] U.S. Cl. ..... 62/129; 62/238.6; 62/305; 62/335; 62/434

[58] Field of Search ..... 62/129, 335, 439, 305, 62/238.6, 126, 498

[56] References Cited

U.S. PATENT DOCUMENTS

| | | | |
|---|---|---|---|
| 3,675,441 | 7/1972 | Perez | 62/434 X |
| 3,763,658 | 10/1973 | Gaumer, Jr. et al. | 62/335 X |
| 3,995,443 | 12/1976 | Iversen | 62/305 |
| 4,000,626 | 1/1977 | Webber | 62/335 X |
| 4,170,117 | 10/1979 | Faxon | 62/305 X |
| 4,266,406 | 5/1981 | Ellis | 62/305 X |
| 4,454,728 | 6/1984 | Hanada et al. | 62/335 X |
| 4,535,603 | 8/1985 | Willitts et al. | 62/238.6 X |
| 4,732,007 | 3/1988 | Dolan et al. | 62/238.6 X |
| 4,819,444 | 4/1989 | Meckler | 62/238.6 |
| 4,827,735 | 5/1989 | Foley | 62/434 X |
| 5,042,262 | 8/1991 | Gyger et al. | 62/434 |
| 5,044,172 | 9/1991 | Inoue et al. | 62/335 |
| 5,072,596 | 12/1991 | Gilbertson et al. | 62/434 X |
| 5,076,067 | 12/1991 | Prenger et al. | 62/126 X |
| 5,211,031 | 5/1993 | Murayama et al. | 62/498 |

*Primary Examiner*—John Rivell
*Attorney, Agent, or Firm*—Roger M. Rickert

[57] ABSTRACT

A refrigeration system is disclosed having first stage and second stage compressors, first stage and second stage evaporator coils, and first stage and second stage condenser coils, each connected together to form first stage and second stage closed loop refrigeration circuits. The two circuits are coupled one to the other by a liquid (water, ethylene glycol of other good heat transfer medium) heat transfer loop which interconnects the second stage evaporator and the first stage condenser to transfer heat from the first stage condenser to the second stage evaporator. A plurality of additional refrigeration circuits may be provided, each including a compressor, an evaporator coil and a condenser coil connected together in a closed loop. In such a case, the liquid heat transfer loop may interconnect the second stage evaporator and each condenser of the additional refrigeration circuits to transfer heat from each additional refrigeration circuit condenser to the second stage evaporator, or may interconnect each second stage evaporator with the first stage condensers to provide a measure of redundancy. Completely separated refrigeration circuits operating in distinct temperature ranges are also disclosed.

21 Claims, 2 Drawing Sheets

REFRIGERATION SYSTEM

SUMMARY OF THE INVENTION

The present invention relates to refrigeration systems generally and more particularly to refrigeration system that would be installed in supermarkets, for example.

Refrigeration systems for supermarkets typically use single stage systems having several refrigerated fixtures each containing its own evaporator for refrigerating the fixture. The fixtures are normally connected to a remote condensing unit containing a compressor and a condenser for completing the refrigeration cycle. These systems typically employ hundreds of feet of copper tubing for carrying refrigerant gas. Not only is the copper tubing very expensive, but also, should a leak occur, anywhere in the system, a very large quantity of expensive and highly environmentally undesirable refrigerant is released into the atmosphere. A salient goal of the present invention is to drastically reduce the amount of refrigerant in these systems and also to eliminate much of the copper tubing thereby reducing initial cost of such systems.

An icebank refrigeration system which provides both air conditioning and cooling for foods or other purposes is disclosed in U.S. Pat. No. 4,280,335 to Perez et al. The patented arrangement utilizes the chilled water directly for several of the cooling functions, thus warming that water rendering it less useful as a cooling medium for a condenser coil. This patented arrangement is not a two-stage system and while it achieves some of the salutary goals as the present invention, it falls short of achieving all.

It is well known that the efficiency of a refrigeration unit is increased when the ambient temperature of the condenser unit is relatively low. It is also known that electrical rates vary with demand and that significantly lower electrical rates are charged at off-peak times, such as overnight. One goal of the present invention is to take advantage of these off-peak rates by freezing water and then using that frozen water to set the temperature of the condenser of the first stage in a two stage for maintaining large freezers (storage locker, etc.) near the 32 degree melting point of water. In essence, the invention freezes water using cheap night-time electricity and then uses the frozen water to improve efficiency of operation during the daytime using expensive electricity. This allows the system to build ice during the night so that the system can more efficiently pump against a 32 degree condenser during the day rather than against a hot out of doors condenser.

It is also well known that an icebank may be used for air conditioning purposes. Another goal of the present invention is to be able to achieve this function along with cooling the condensers of the first stage refrigeration units. It is known that a chiller refrigeration unit may be used for air conditioning purposes. It is a further goal of the present invention is to provide chilled water for air conditioning purposes with the same equipment used for refrigeration of foods. Not only does this eliminate the need for separate air conditioning equipment, but should a leak occur on a chilled water coil, no refrigerant gas escapes.

Finally, it is well known that if the condenser unit refrigeration system becomes too warm, the system can experience serious damage and catastrophic damage to the compressor may result. An attempt to avoid this problem by water cooling of a coil is disclosed in U.S. Pat. No. 2,660,863. Another goal of the present invention is an emergency or fail-safe refrigeration system condenser unit where if the condenser unit gets too hot, an automatic sprinkler system kicks in to spray water directly onto the hot coils to cool them. An alarm and/or system shut-down may also be initiated. Such immediate cooling action will frequently avoid damage (typically to the compressor) which might otherwise occur due to excessive pressure within the system, as well as avoiding costly product loss and down time Among the several objects of the present invention may be noted the provision of a refrigeration system wherein inadvertent leakage of refrigerant is maintained at a very low level; the provision of a versatile large-scale refrigerating system; the provision of a refrigeration system which may use more than one refrigeration unit for low temperature stage and more than one refrigeration unit for higher temperature refrigeration with the low temperature stages coupled to the high stages by a liquid circulating loop; the provision of a multiple refrigeration unit refrigeration system which is easily reconfigured to adapt to changing environmental conditions; and the provision of a multiple compressor refrigeration system operable at near optimum compression ratios for each compressor. These as well as other objects and advantageous features of the present invention will be in part apparent and in part pointed out hereinafter.

In general, a refrigeration system according to the present invention in one form has a first stage compressor, a first stage evaporator coil and a first stage condenser coil connected together in a first stage closed loop refrigeration circuit; and a second stage compressor, a second stage evaporator coil and a second stage condenser coil connected together in a second stage closed loop refrigeration circuit. There is a liquid heat transfer loop interconnecting the second stage evaporator and the first stage condenser to transfer heat from the first stage condenser to the second stage evaporator. Multiple parallel stages maybe provided throughout.

BRIEF DESCRIPTION OF THE DRAWING

Corresponding reference characters indicate corresponding parts throughout the several views of the drawing.

The exemplifications set out herein illustrate a preferred embodiment of the refrigeration system in one form thereof. Numerous modifications will readily suggest themselves to those of ordinary skill in this art. Accordingly, such exemplifications are not to be construed as limiting the scope of the disclosure or the scope of the invention in any manner.

DESCRIPTION OF THE PREFERRED EMBODIMENT

Figure 1:
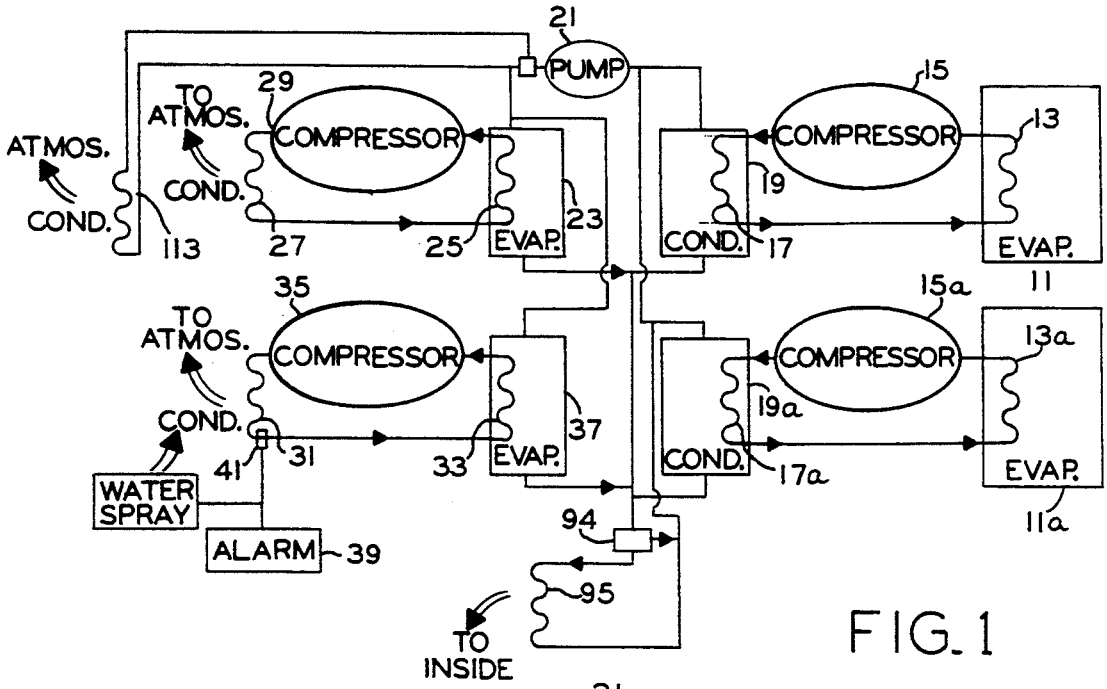
FIG. 1 is a schematic representation of a refrigeration system employing a plurality of chilling units coupled by a liquid heat transfer loop to a plurality of low temperature units.
Figure 2:
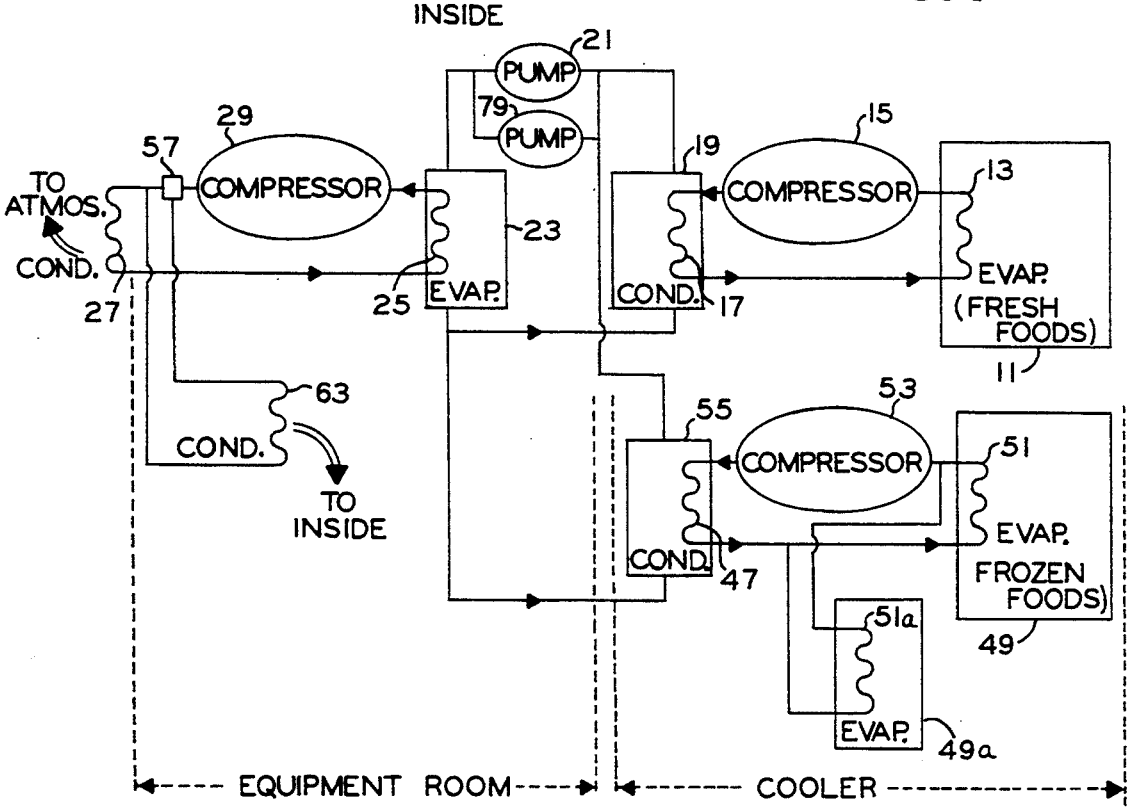
FIG. 2 is a schematic representation of a refrigeration system similar to that of FIG. 1, but showing a plurality of low temperature units coupled by a liquid heat transfer loop to a single chilling unit.

In FIG. 1, a refrigeration system is seen to include a high stage (relatively warm) refrigeration circuit comprising compressor 29, evaporator coil 25 and condenser coil 27. Conventional features and refinements, such as pumps, check valves, circulating fans, defrosting units or cycles and the like common to such a refrigeration circuit, but not necessary for a complete understanding of the present invention are not shown for reasons of simplicity. It will be understood that such features may be either present or contemplated. The system also includes a first (cold) stage refrigeration circuit comprising the condenser coil 17, compressor 15 and evaporator coil 13. The first stage compressor 15 is preferably a scroll type compressor. The evaporator coil 13 is disposed within a cooler, e.g., a meat freezer, to maintain the food therein within a desired temperature range. The two refrigeration circuits are coupled together by a liquid heat transfer loop which includes the pump 21, enclosure 19 and enclosure 23. This loop interconnects the second stage evaporator (coil 25) and the first stage condenser (coil 17) to transfer heat from the first stage condenser 17 to the second Stage evaporator 25. In FIG. 2, a second first stage refrigeration circuit having evaporator coil 51, compressor 53 and condenser coil 47 is connected in parallel with the other first stage circuit. This second first stage circuit might, for example, function to cool a frozen foods cabinet 49.

Figure 3:
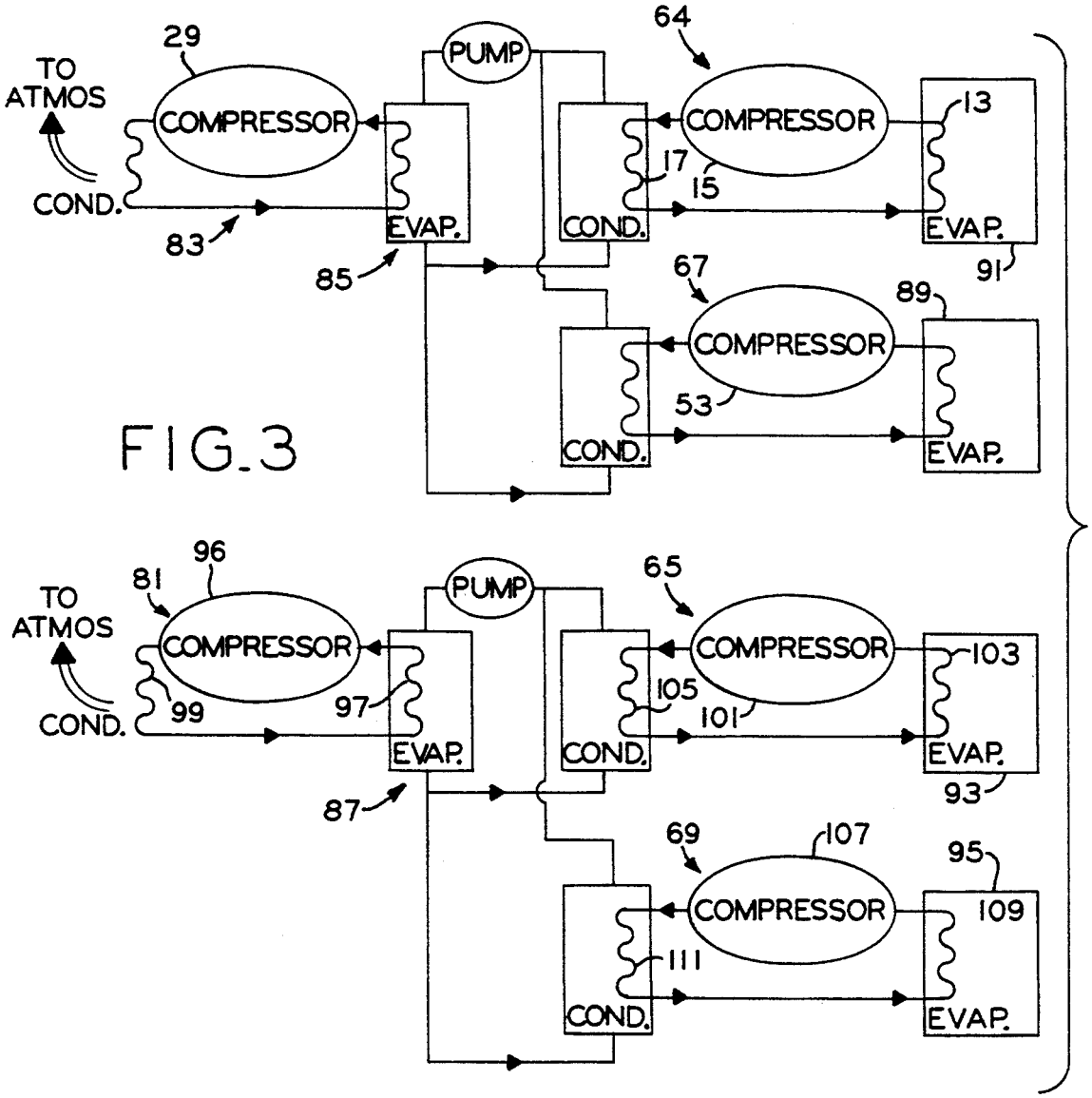
FIG. 3 is a schematic representation of a refrigeration system similar to that of FIGS. 1 and 2, but showing a plurality of low temperature units coupled by two separate liquid heat transfer loops to a pair of chilling units.

The several units such as 11 and 11*a* in FIG. 1, 11 and 49 in FIG. 2, and 89, 91, 93 and 95 in FIG. 3 are all identified as first stage or low temperature units near the right end of the respective drawing figures are coolers as might contain icecream, frozen foods, dairy products etc. Note that as far as the CFC refrigerant material (FREON) is concerned, each unit is a stand alone unit not connected to any of the others nor to the second stage (outside higher temperature) units. In the drawing, heat is generally being pumped from the right toward the left. All of the lengthy heat transfer interconnection between the enclosures or containers such as 19, 23 and 55 is by water, not FREON. Thus, if a leak should occur, water, ethylene glycol; or only a relatively small amount of FREON or other refrigerant is freed and damage to the ozone layer is minimized. The concept is the same as saying that if we shipped crude oil in canoes, no spill could be catastrophic.

This same small, stand-alone architecture of refrigerating units has a second similar benefit. The "Group 2" refrigerants such as ammonia and sulphur dioxide are very efficient and are not generally harmful to the environment (ozone). They are, however, very harmful to people in a confined area such as a grocery store. The high stage (warmer) unit being located outside may now be charged with such a Group 2 refrigerant since none of the refrigerant in the high stage unit is circulated into the store. The lower temperature self-contained systems may also use Group 2 refrigerants if the charge level in each is kept at a safe (relatively low) level.

For the purpose of capacity staging and back-up in the event of system failure of one of the second stage units, the second stage unit (warmer left end) may also be designed as several smaller units to cool the water preparatory to its being returned to the individual first stage units within the store as shown generally in FIGS. 2 and 3. Again, no leak can be catastrophic.

It is possible to configure a container such as 23 so that operation of the compressor 29 during off-peak times can be used to build up ice within the container. Container 23 then functions as a thermal storage tank containing a freezable material such as water, and is connected in series in the liquid heat transfer loop with the second stage evaporator 25 adapted to selectively freeze the material in the thermal storage tank. During peak times, the ice is melted and operation of the compressor 29 on "expensive electricity" is minimized. Such an ice reservoir takes advantage of significantly lower electrical rates at off-peak times, such as overnight, by using second stage compressors to freeze water and then using the latent heat of the ice to set the temperature of the condenser such as 17 or 47 in a first stage refrigeration cycle for maintaining large freezers such as 11 or 49 at temperatures near the 32 degree melting point of ice.

FIGS. 1 and 2 illustrate single refrigeration systems while FIG. 3 depicts two independent refrigeration systems. In FIG. 1, there is a second first stage (cold) unit identified as 11*a*, 13*a*, 15*a*, 17*a* and 19*a*. In general, there will be at least as many and generally more cold (first) stages as second stages. In each case there is a second stage closed loop refrigeration circuit including a second stage compressor 29, a second stage evaporator coil 25 and a second stage condensor coil 27. This is the warm circuit which rejects heat to the atmosphere. Also each case there is a first stage compressor 15, a first stage evaporator coil 13, and a first stage condenser coil 17 connected together in a first stage (low temperature) closed loop refrigeration circuit which is located at the particular frozen food cabinet 11 or the like and directly cools the contents thereof. A liquid (e.g., water or ethylene glycol) heat transfer loop comprising pump 21 and water or other thing enclosures 19 and 23 interconnects the second stage evaporator 25 and the first stage condenser 17 to transfer heat from the first stage condenser to the second stage evaporator. A plurality of additional refrigeration circuits are shown in FIG. 2 for cooling a plurality of frozen food or meat storage locations such as 11 and 49 as shown. Moreover, FIG. 2 illustrates multiple cases such as 49*a* cooled by the same compressor. In FIG. 2, the space between the equipment room and the cooler appears very small. In fact, this distance is rather large and, were it not for the fact that the tubing interconnecting these two locations is filled with water or similar benign material, leakage could be a significant problem. Each low temperature additional refrigeration circuit includes a compressor 53, an evaporator coil 51, and a condenser coil 47 connected together in a closed loop. The liquid heat transfer loop interconnects the second stage evaporator 25 and each condenser 47 of the additional refrigeration circuits to transfer heat from each additional refrigeration circuit condenser to the second stage evaporator.

Separate liquid heat transfer loops may be employed as shown in FIG. 8. The refrigeration system may have a first series of coolers 89, 91 with local refrigeration circuits 64 and 67 which operate in a below freezing temperature range and a second series of coolers 93, 95 with circuits 65, 69 designed for operation in a cool, but above freezing range. Such an independent pair of systems may employ a second second stage compressor 96, a second second stage evaporator coil 97, and a second second stage condenser coil 99 connected together in a closed loop refrigeration circuit 81 and a second first stage compressor 101, a second first stage evaporator coil 103 and a second first stage condenser coil 105 connected together in a closed loop refrigeration circuit 65. A second liquid heat transfer loop 87 interconnects the second second stage evaporator 97 and the second first stage condenser 105 to transfer heat from the second first stage Condenser to the second second stage evaporator.

Still referring to FIG. 3, the refrigeration system may include a plurality of further refrigeration circuits such as 89, each having a compressor 107, an evaporator coil 109 and a condenser coil 111 connected together in a closed loop, the second liquid heat transfer loop 87 interconnecting the second second stage evaporator 97 and each first stage condenser such as 111 of the further refrigeration circuits to transfer heat from each further first stage refrigeration circuit condenser to the second second stage evaporator. As explained earlier, this dual system allows for situations where the desired operating temperature of certain ones of the components (e.g., the first first stage evaporator coil 13 and its corresponding condenser coil 17) of the first series is substantially different than the desired operating temperature of corresponding components (e.g., the second first stage evaporator coil 103 and its corresponding condenser coil 105) in the second series as would be the case, for example, with a fresh food system and a frozen food system.

Returning now to FIG. 1, another compressor 35, another evaporator coil 33, and another condenser coil 31 are connected together in a second second stage closed loop refrigeration circuit and the liquid heat transfer loop interconnects the second stage evaporator 25, the additional evaporator 33, and the first stage condenser 17 to transfer heat from the first stage condenser 17 to the second stage and another evaporators 25 nd 33 respectively. In this configuration, both the second stage and said another condensers reject heat into the atmosphere. The second stage compressor 35 may only need to be run when the external atmospheric temperature is quite high.

Each of the drawing figures includes some variations any of which could be incorporated into other of the drawing figures. Such variations are depicted in but a single system for simplicity of explanation. In each figure, the second condenser 27, 31 or 99 rejects heat into the atmosphere. Rather than reject this heat into the atmosphere during the cold winter months, a valve 57 maybe actuated to divert the hot compressed gas to the condenser 63 within a building to help heat that building. Again depending on the particular combination of sufficiently low exterior temperature and system demand, an additional exterior heat exchange device 113 such as a coil in FIG. 1 may accept warm liquid in the heat transfer loop series with the second stage evaporator 25 to transfer heat from the first stage condenser 17 directly to the atmosphere by way of the exterior heat exchange device 113. This heat transfer may be direct as shown in FIG. 1 or indirect by way of a heat exchanger.

FIG. 1 shows a chilled water cooling coil 98 and a diverting valve 94 which may be actuated during hot summer months to connect the coil 98 in parallel with condensers 17 and 17*a* to cool the inside of a building. FIG. 1 also shows a temperature probe or pressure switch 41 which monitors the temperature of condenser coil 31. A warning indication 39 in the form of a flashing light, audible alarm or similar device is enabled in the event that the monitored temperature becomes excessive. Moreover, this alarm may initiate some other corrective action. For example, a coolant such as water may be sprayed from a source onto the condenser being monitored.

While the several liquid containers such as 23 and 37 of FIG. 1 have been shown as individual to a particular evaporator coil, these may share a common liquid container. Also, more than one circulating pump 21 and 79 are shown in FIG. 2. Dual pumps provide both a measure of redundancy and economy of operation since only one pump need be run during low demand times.

From the foregoing, it is now apparent that a novel large-scale refrigerating system has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. A refrigeration system for a supermarket comprising:

a refrigerated frozen food fixture for containing frozen foods;

a first stage scroll type compressor, a first stage evaporator coil and a first stage condenser coil connected together in a first stage closed loop refrigeration circuit, the first stage evaporator coil being adapted to maintain food in the refrigerated fixture in a frozen state;

a second stage compressor, a second stage evaporator coil and a second stage condenser coil connected together in a second stage closed loop refrigeration circuit, the second stage condenser adapted to reject heat into the atmosphere outside the supermarket;

a liquid heat transfer loop interconnecting the second stage evaporator and the first stage condenser to transfer heat from the first stage condenser to the second stage evaporator, the first stage condenser, first stage compressor and first stage evaporator all being located remote from the second stage evaporator;

an interior heat exchange device and a valve operable to divert the refrigerant in the second stage closed loop refrigeration circuit from the second stage condenser to the interior heat exchange device for interior supermarket heating purposes; and an interior heat exchange device selectively connectable in the liquid heat transfer loop in parallel with the first stage condensor coil for interior supermarket cooling purposes.

2. The refrigeration system of claim 1 further comprising a plurality of additional first stage refrigeration circuits each including a compressor, an evaporator coil and a condenser coil connected together in a closed loop, the liquid heat transfer loop interconnecting the second stage evaporator and each condenser of the additional first stage refrigeration circuits to transfer heat from each additional first stage refrigeration circuit condenser to the second stage evaporator.

3. The refrigeration system of claim 1 further comprising a second second stage compressor, a second second stage evaporator coil and a second second stage condenser coil connected together in a closed loop refrigeration circuit;

a second first stage compressor, a second first stage evaporator coil and a second first stage condenser coil connected together in a closed loop refrigeration circuit; and a second liquid heat transfer loop interconnecting the second second stage evaporator and the second first stage condenser to transfer heat from the second first stage condenser to the second second stage evaporator.

4. The refrigeration system of claim 3 further comprising a plurality of further first stage refrigeration circuits each including a compressor, an evaporator coil and a condenser coil connected together in a closed loop, the second liquid heat transfer loop interconnecting the second second stage evaporator and each condenser of the further first stage refrigeration circuits to transfer heat from each further first stage refrigeration circuit condenser to the second second stage evaporator.

5. The refrigeration system of claim 3 wherein the desired operating temperature of the first first stage evaporator coil and condenser coil is substantially different than the desired operating temperature of the second first stage evaporator coil and condenser coil.

6. The refrigeration system of claim 1 further comprising another compressor, another evaporator coil and another condenser coil connected together in a closed loop refrigeration circuit, the liquid heat transfer loop interconnecting the second stage evaporator, said another evaporator, and the first stage condenser to transfer heat from the first stage condenser to the second stage and another evaporators.

7. The refrigeration system of claim 6 wherein both the second stage and said another condensers reject heat into the atmosphere.

8. The refrigeration system of claim 1 wherein the second stage condenser rejects heat into the atmosphere, and further comprising an exterior heat exchange device in series in the heat transfer loop with the second stage evaporator to transfer heat from the first stage condenser directly to the exterior heat exchange device and then to the atmosphere.

9. The refrigeration system of claim 1 further comprising means for monitoring the temperature of at least one condenser coil and for providing a warning indication in the event that monitored temperature becomes excessive.

10. The refrigeration system of claim 11 further comprising means responsive to an excessive temperature warning indication for supplying a coolant to the condenser being monitored.

11. The refrigeration system of claim 1 further comprising a thermal storage tank containing a freezable material and connected in series in the liquid heat transfer loop with the second stage evaporator adapted to selectively freeze the material in the thermal storage tank.

12. The refrigeration system of claim 11 wherein the first stage condensers are directly cooled by liquid cooled by frozen material in the thermal storage tank and circulating in the liquid heat transfer loop.

13. The refrigeration circuit of claim 1 wherein the first stage compressor, condenser, and evaporator are located at the refrigerated fixture and the second stage compressor, condenser and evaporator are located in a remote environment.

14. A refrigeration system comprising:

a refrigerated fixture for the refrigeration of foods;

a first stage compressor, a first stage evaporator coil and a first stage condensor coil connected together in a first stage closed loop refrigeration circuit, the first stage compressor, condensor, and evaporator being located at the refrigerated fixture and the first stage evaporator coil being adapted to maintain the food in the refrigerated fixture within a desired temperature range;

a second stage compressor, a second stage evaporator coil and a second stage condensor coil connected together in a second stage closed loop refrigeration circuit, the second stage compressor, condensor, and evaporator being located in a remote environment; and a liquid heat transfer loop extending between the refrigerated fixture and the remote environment and interconnecting the second stage evaporator and the first stage condenser in continuous communication to transfer heat from the first stage condenser to the second stage evaporator.

15. The refrigeration system of claim 14 further comprising a second second stage compressor, a second second stage evaporator coil and a second second stage condenser coil connected together in a closed loop refrigeration circuit;

a second first stage compressor, a second first stage evaporator coil and a second first stage condensor coil connected together in a closed loop refrigeration circuit; and a second liquid heat transfer loop interconnecting the second second stage evaporator and the second first stage condenser to transfer heat from the second stage condenser to the second stage evaporator; and wherein the desired operating temperature of the first first stage evaporator coil and condenser coil is substantially different than the desired operating temperature of the second first stage evaporator coil and condensor coil.

16. The refrigeration system of claim 15 further comprising a plurality of further first stage refrigeration circuits each including a compressor, an evaporator coil and a condensor coil connected together in a closed loop, the second liquid heat transfer loop interconnecting the second second stage evaporator and each condenser of the further first stage refrigeration circuits to transfer heat from each further first stage refrigeration circuit condenser to the second second stage evaporator.

17. The supermarket refrigeration system of claim 14 wherein the first stage condenser, first stage compressor and first stage evaporator are all located at the refrigerated fixture and remote from the second stage evaporator, and the liquid heat transfer loop contains a benign liquid material to thereby minimize the likelihood of dangerous material leakage.

18. The supermarket refrigeration system of claim 17 wherein the benign liquid material comprises at least one of water and ethylene glycol.

19. The refrigeration system of claim 14 further comprising an interior heat exchange device and a valve operable to divert the refrigerant in the second stage closed loop refrigeration circuit from the second stage condenser to the interior heat exchange device for interior heating purposes.

20. A supermarket refrigeration system comprising:

a first stage compressor, a first stage evaporator coil and a first stage condenser coil connected together in a first stage closed loop refrigeration circuit;

a second stage compressor, a second stage evaporator coil and a second stage condenser coil connected together in a second stage closed loop refrigeration circuit, the second stage condenser adapted to reject heat into the atmosphere exterior to the supermarket;

a liquid heat transfer loop interconnecting the second stage evaporator and the first stage condenser to transfer heat from the first stage condenser to the second stage evaporator at a location remote from the first stage condenser;

an interior heat exchange device and a valve operable to divert the refrigerant in the second stage closed loop refrigeration circuit from the second stage condenser to the interior heat exchange device to transfer heat from the second stage evaporator to the interior heat exchange device for interior supermarket heating purposes; and an interior heat exchange device selectively connectable in parallel with the first stage condensor coil for interior supermarket cooling purposes.

21. A supermarket refrigeration system comprising:

a refrigerated fixture for the refrigeration of foods;

a scroll type first stage compressor, a first stage together in a first stage closed loop refrigeration circuit, the first stage closed loop refrigeration circuit being located in close proximity to the refrigerated fixture and the first stage evaporator coil being adapted to maintain the food in the refrigerated fixture within a desired temperature range;

an exterior heat exchange device located in a remote environment outside the supermarket for transferring heat to the exterior atmosphere; and a closed liquid heat transfer loop extending between the refrigerated fixture and the remote environment and interconnecting the exterior heat exchange device and the first stage condenser in continuous communication to transfer heat from the first stage condenser to the exterior heat exchange device.

* * * * *